US008123321B2

(12) United States Patent
Mizutani

(10) Patent No.: US 8,123,321 B2
(45) Date of Patent: Feb. 28, 2012

(54) IMAGE FORMING METHOD AND IMAGE FORMING APPARATUS

(75) Inventor: Toshiyuki Mizutani, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 566 days.

(21) Appl. No.: 12/341,029

(22) Filed: Dec. 22, 2008

(65) Prior Publication Data

US 2009/0167805 A1 Jul. 2, 2009

(30) Foreign Application Priority Data

Dec. 27, 2007 (JP) ..... 2007-336435

(51) Int. Cl.
*B41J 2/205* (2006.01)
*B41J 29/393* (2006.01)
*B41J 2/21* (2006.01)

(52) U.S. Cl. ..... 347/15; 347/5; 347/6; 347/9; 347/12; 347/19; 347/20; 347/40; 347/43

(58) Field of Classification Search ..... 347/15, 347/19, 43; 358/3.06, 3.09, 3.1
See application file for complete search history.

(56) References Cited

U.S. PATENT DOCUMENTS 6,779,865 B2 8/2004 Shibata et al.
2005/0253882 A1* 11/2005 Mizutani et al. ..... 347/9
2006/0098045 A1* 5/2006 Mizutani et al. ..... 347/43
2006/0181738 A1* 8/2006 Mizutani et al. ..... 358/3.12
2007/0057986 A1* 3/2007 Arazaki et al. ..... 347/15
2007/0064272 A1* 3/2007 Mizutani et al. ..... 358/3.14
2007/0211100 A1* 9/2007 Mizutani et al. ..... 347/19

FOREIGN PATENT DOCUMENTS

JP 2-22066 A 1/1990
JP 2002-67297 A 3/2002

OTHER PUBLICATIONS

Dooley et al., "Noise Perception in Electrophotography", Journal of Applied Photographic Engineering vol. 5, No. 4, 1979, pp. 190-196.

* cited by examiner

*Primary Examiner* — Ryan Lepisto

(74) *Attorney, Agent, or Firm* — Holtz, Holtz, Goodman & Chick, PC

(57) ABSTRACT

An image forming apparatus includes a defect position detecting section to detect a defect position at which no recording material is outputted; a defect position specifying section to specify a defect recording element, which resides at the defect position, and a kind of recording material to be outputted by the defect recording element; a mixture ratio determining section to determine a mixture ratio of plural recording materials, so as to make the mixture ratio of a specific recording material to be outputted by plural recording elements residing in a peripheral area of the defect position and including the defect recording element, decrease to a value lower than a normal mixture ratio, while using the normal mixture ratio for other recording elements residing in other areas.

20 Claims, 12 Drawing Sheets

BEFORE CORRECTION

AFTER CORRECTION

IMAGE FORMING METHOD AND IMAGE FORMING APPARATUS

This application is based on Japanese Patent Application No. 2007-336435 filed on Dec. 27, 2007, with Japan Patent Office, the entire content of which is hereby incorporated by reference.

BACKGROUND OF THE INVENTION

The present invention relates to an image forming method and an image forming apparatus, each for forming an image in such a manner that plural kinds of recording materials (such as coloring material, dyestuff, pigment, color ink, etc.), belonging to a same color category but being different in density, are emitted and distributed onto/over a recording medium by a plurality of recording elements, respectively, so as to form dots representing the image to be printed on the recording medium.

In the ink-jet printer or the like, an image is formed on a recording paper sheet (recording medium) by emitting ink droplets (recording materials) from a plurality of nozzles (included in the recording elements) In this case, an ink clogging failure is liable to occur, and accordingly, a white line is generated in the image to be formed on the recording paper sheet, due to an influence of a nozzle suffered by this ink clogging failure (a defective nozzle).

In order to eliminate the white line caused by the ink clogging failure, various kinds of methods have been considered and proposed so far. For instance, Tokkaihei 2-22066, Tokkai 2002-67297 (both Japanese Non-Examined Patent Publication), etc., have set forth various kinds of countermeasures to cope with the abovementioned failure.

Concretely speaking, Tokkaihei 2-22066 sets forth a method for detecting a defective nozzle that is incapable of emitting ink, and for eliminating the white line by employing an interpolating nozzle that corresponds to the defective nozzle. Further, Tokkai 2002-67297 sets forth a method for arranging interpolating nozzles in the vicinity of the defective nozzle that is incapable of emitting ink so as to interpolate the white line with the ink belonging to the color category same as that of the non-emission nozzle but being different in density, another method for emitting transparent ink from the interpolating nozzle, etc.

However, in every one of abovementioned methods, it is necessary to accurately locate the defective position at which the corresponding nozzle is incapable of emitting ink, and then, it is necessary to accurately position the interpolating nozzle at the defective position, so as to accurately conduct the ink emitting operation for interpolating the defect at a predetermined accuracy.

Therefore, there has been such a shortcoming that the ink emitting operation to be conducted at the defective position should be implemented at an accuracy being same as a nozzle arranging resolution (a number of nozzles for every unit length), resulting in a high accurate operating demand. To cope with such the shortcoming, there have been arisen various kinds of problems, such as a cost increase for increasing the resolution of the detecting section, an increase of arithmetic calculating load, etc.

SUMMARY OF THE INVENTION

To overcome the abovementioned drawbacks in conventional image forming method and apparatus, it is one of objects of the present invention to provide image forming method and apparatus, each of which makes it possible to conduct the countermeasure, for eliminating such a defect that the recording material is not outputted from the recording element, with an accuracy lower than the arranging resolution of the recording elements, when forming an image in such a manner that plural kinds of recording materials, belonging to a same color category but being different in density, are emitted and distributed onto/over a recording medium by a plurality of recording elements, respectively, so as to form dots representing the image to be printed on the recording medium.

Accordingly, at least one of the objects of the present invention can be attained by any one of the image forming methods and apparatuses described as follows.

(1) According to an image forming method reflecting an aspect of the present invention, the image forming method for forming an image in such a manner that plural kinds of recording materials, belonging to a same color category but being different in density, are adhered onto a recording medium by a plurality of recording elements, respectively, so as to form dots representing the image to be printed on the recording medium, the image forming method comprising: detecting a defect position at which no recording material is outputted from one of the plurality of recording elements; identifying said one of the plurality of recording elements, which resides at the defect position detected in the detecting step, with a defect recording element, and then, also identifying a kind of the recording material that cannot be outputted by the defect recording element with a defect recording material; determining a mixture ratio of the plural kinds of recording materials, belonging to the same color category but being different in density, for every position of the plurality of recording elements, in such a manner that the mixture ratio at each position of recording elements that reside in the peripheral area of the defect position and includes the defect recording element, identified in the identifying step, is lower than that at each position of other recording elements that reside in an area other than the peripheral area of the defect position and is capable of outputting the defect recording material identified in the identifying step; converting the image data to dot ratios, which respectively correspond to the plural kinds of recording materials, based on the mixture ratio determined in the determining step; and executing controlling operations, so as to implement an image forming operation by employing the dot ratios, which respectively correspond to the plural kinds of recording materials and acquired in the converting step.

(2) According to another aspect of the present invention, the image forming method recited in item 1 further comprises: retaining the mixture ratio and a gradation correction characteristic corresponding to the mixture ratio concerned, while correlating them with each other; wherein the controlling operations are executed by referring to a correspondence relationship between the mixture ratio and the gradation correction characteristic corresponding to the mixture ratio concerned, and by using the gradation correction characteristic corresponding to the mixture ratio determined in the determining step.

(3) According to still another aspect of the present invention, in the image forming method recited in item 1, in the detecting step, the defect position is detected by determining whether or not the recording material is outputted for every set of plural recording elements.

(4) According to still another aspect of the present invention, in the image forming method recited in item 1, in the detecting step, the defect position is detected from a result of measuring a density distribution of an image printed in a longitudinal direction of an arrangement of the plurality of recording elements.

(5) According to still another aspect of the present invention, in the image forming method recited in item 1, in the detecting step, a detecting operation is performed under such a condition that a detecting resolution is coarser than an arrangement resolution of the plurality of recording elements.

(6) According to still another aspect of the present invention, in the image forming method recited in item 1, in the determining step, the mixture ratio is changed continuously or stepwise over an area from the defect position to other positions that reside in the peripheral area of the defect position and have no defect.

(7) According to still another aspect of the present invention, the image forming method recited in item 4 further comprises: acquiring two dimensional image densities in both an element arrangement direction of the plurality of recording elements and a direction orthogonal to the element arrangement direction; wherein the mixture ratio is determined corresponding to the two dimensional image densities.

(8) According to still another aspect of the present invention, the image forming method recited in item 5 further comprises: calculating a number of defect recording elements included in each of plural areas into which the plurality of recording elements are divided and a number of which is smaller than a total number of the plurality of recording elements; wherein the mixture ratio is determined corresponding to the number of defect recording elements, calculated in the calculating step.

(9) According to still another aspect of the present invention, in the image forming method recited in item 1, a gradation correction curve is established, so as to set a density, which can be represented by using only a lowest-density recording material among recording materials belonging to a same color category but being different in density, at a maximum density.

(10) According to yet another aspect of the present invention, in the image forming method recited in item 1, the recording material is an ink, and the recording element is a nozzle that emits the ink.

(11) According to an image forming apparatus reflecting another aspect of the present invention, the image forming apparatus for forming an image in such a manner that plural kinds of recording materials, belonging to a same color category but being different in density, are adhered onto a recording medium by a plurality of recording elements, respectively, so as to form dots representing the image to be printed on the recording medium, comprises a defect position detecting section to detect a defect position at which no recording material is outputted from one of the plurality of recording elements; a defect position identifying section not only to identify said one of the plurality of recording elements, which resides at the defect position detected by the defect position detecting section, with a defect recording element, but also to identify a kind of the recording material that cannot be outputted by the defect recording element with a defect recording material; a mixture ratio determining section to determine a mixture ratio of the plural kinds of recording materials, belonging to the same color category but being different in density, for every position of the plurality of recording elements, in such a manner that the mixture ratio at each position of recording elements that reside in the peripheral area of the defect position and includes the defect recording element, identified by the defect position identifying section, is lower than that at each position of other recording elements that reside in an area other than the peripheral area of the defect position and is capable of outputting the defect recording material identified by the defect position identifying section; an image data converting section to convert the image data to dot ratios, which respectively correspond to the plural kinds of recording materials, based on the mixture ratio determined by the mixture ratio determining section; and a controlling section to execute controlling operations, so as to implement an image forming operation by employing the dot ratios, which respectively correspond to the plural kinds of recording materials and acquired by the image data converting section

(12) According to still another aspect of the present invention, the image forming apparatus recited in item 11, further comprises: a retaining section to retain the mixture ratio and a gradation correction characteristic corresponding to the mixture ratio concerned, while correlating them with each other; wherein the controlling section executes the controlling operations by referring to a correspondence relationship between the mixture ratio and the gradation correction characteristic corresponding to the mixture ratio concerned, and by using the gradation correction characteristic corresponding to the mixture ratio determined by the mixture ratio determining section.

(13) According to still another aspect of the present invention, in the image forming apparatus recited in item 11, the defect position detecting section detects the defect position by determining whether or not the recording material is outputted for every set of plural recording elements.

(14) According to still another aspect of the present invention, in the image forming apparatus recited in item 11, the defect position detecting section detects the defect position from a result of measuring a density distribution of an image printed in a longitudinal direction of an arrangement of the plurality of recording elements.

(15) According to still another aspect of the present invention, in the image forming apparatus recited in item 11, the defect position detecting section performs a detecting operation under such a condition that a detecting resolution is coarser than an arrangement resolution of the plurality of recording elements.

(16) According to still another aspect of the present invention, in the image forming apparatus recited in item 14, the mixture ratio determining section changes the mixture ratio continuously or stepwise over an area from the defect position to other positions that reside in the peripheral area of the defect position and have no defect.

(17) According to still another aspect of the present invention, the image forming apparatus recited in item 14, further comprises: an image density acquiring section to acquire two dimensional image densities in both an element arrangement direction of the plurality of recording elements and a direction orthogonal to the element arrangement direction; wherein the mixture ratio is determined corresponding to the two dimensional image densities.

(18) According to still another aspect of the present invention, the image forming apparatus recited in item 15, further comprises: a defect number calculating section to calculate a number of defect recording elements included in each of plural areas into which the plurality of recording elements are divided and a number of which is smaller than a total number of the plurality of recording elements; wherein the mixture ratio is determined corresponding to the number of defect recording elements, calculated by the defect number calculating section.

(19) According to still another aspect of the present invention, in the image forming apparatus recited in item 11, a gradation correction curve is established, so as to set a density, which can be represented by using only a lowest-density recording material among recording materials belonging to a same color category but being different in density, at a maximum density.

(20) According to still another aspect of the present invention, in the image forming apparatus recited in item 11, the recording material is an ink, and the recording element is a nozzle that emits the ink.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 8(*b*) shows a graph indicating an assumed transition of granularities of divided regions shown in FIG. 8(*b*;

FIG. 8)*c*) shows a graph indicating a relationship between granularity and value "m", representing a mixture ratio of high and low density colors;

FIG. 8(*d*) shows a graph indicating a transition curve of granularity versus value "m", when a nozzle defect exists in a low-density ink emission head;

DETAILED DESCRIPTION OF THE PREFERRED EMBODIMENT

First Embodiment

Figure 1:
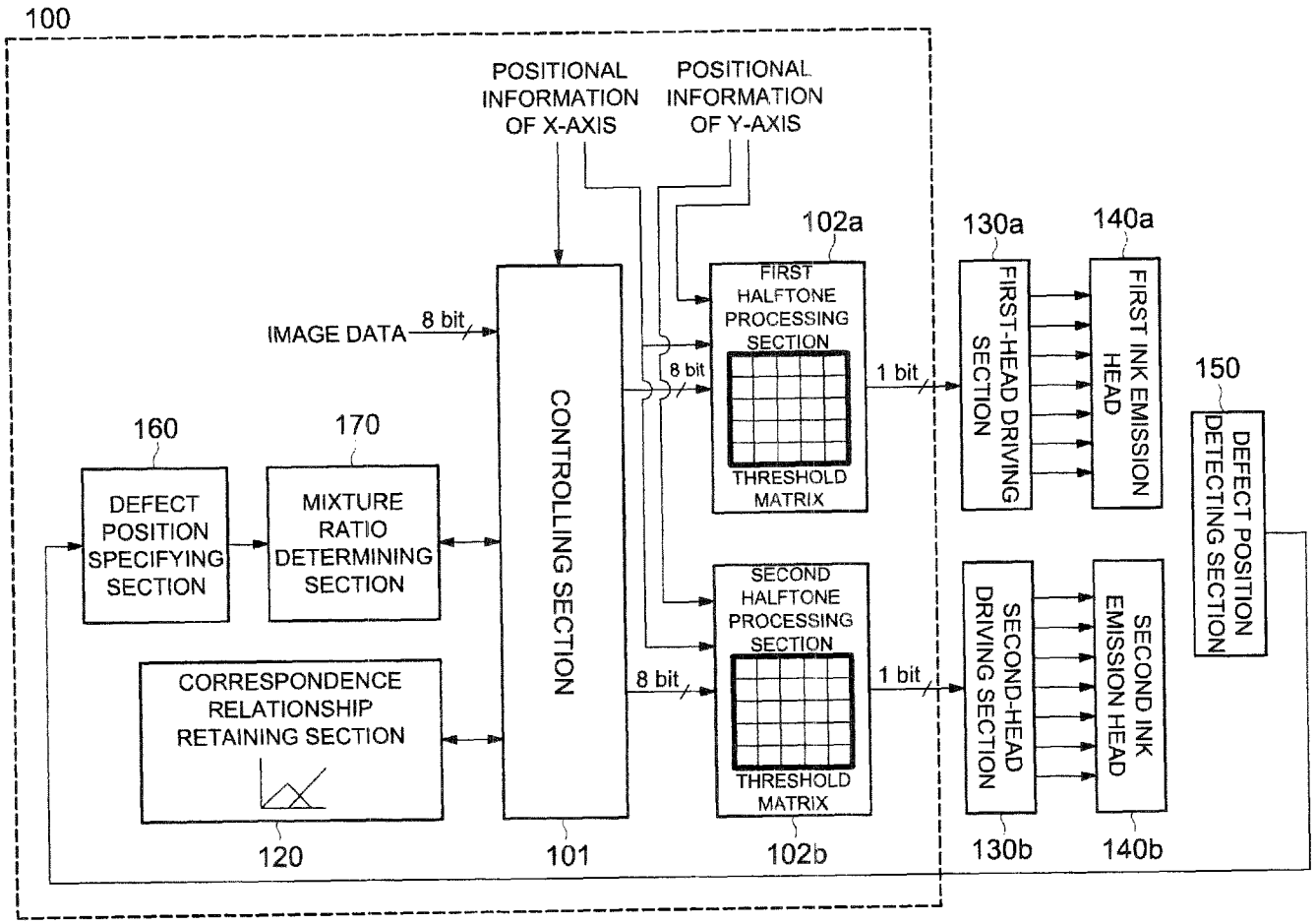
FIG. 1 shows a block diagram of a data processing configuration of an image forming apparatus embodied in the present invention.

Referring to the drawings, the first embodiment of the present invention will be detailed in the following. Initially, the image forming method and apparatus, embodied in the present invention, will be detailed in the following.

In this connection, an ink-jet printer is exemplified as the image forming apparatus to explain the concrete example of the present embodiment. Accordingly, ink corresponds to the recording material, and nozzles that emit ink correspond to the recording element.

Further, the ink-jet printer to be described as the concrete example in the following, employs two kinds of recording materials, belonging to a same color category but being different in density, namely, a high-density ink and a low-density ink. In this connection, although a color printer normally employs both a high-density ink and a low-density ink for every one of colors of Y (Yellow), M (Magenta), C (Cyan) and K (Black), the ink-jet printer, embodied in the present invention, employs both a high-density ink and a low-density ink for any one of the colors.

Still further, structural elements, specifically relates to features of an image forming apparatus 100, will be mainly detailed in the following embodiment. Accordingly, explanations in regard to other structural elements that are well known as the general purpose structural elements to be employed in the image forming apparatus, such as a rasterize processing, a color conversion processing, etc., will be omitted in the following.

FIG. 1 shows a block diagram of the configuration for data processing to be conducted in the image forming apparatus embodied in the present invention. As shown in FIG. 1, a controlling section 101 conducts various kinds of controlling operations in the image forming apparatus of the first embodiment. Specifically in the present embodiment, the controlling section 101 conducts the controlling operations including the steps of: detecting a defect position at which no recording material is outputted from a specific one of the plurality of recording elements; identifying one of the plurality of recording elements, which resides at the defect position detected in the detecting step, with a defect recording element, and a kind of recording material to be outputted by the defect recording element; determining information of a mixture ratio of high and low density inks versus information of a nozzle position (positional information in regard to value "x") (mixture ratio dot profile), so as to make the mixture ratio of a specific recording material to be outputted by plural recording elements residing in a peripheral area of the defect position and including the defect recording element identified in the identifying step, decrease to a value lower than a normal mixture ratio, while using the normal mixture ratio for other recording elements residing in other areas; and calculating a value of image data at the concerned position as the correction value for a first ink emission head and a second ink emission head, which respectively emit low-density ink and high-density ink, based on the positional information of "x" and referring to the mixture ratio dot profile determined in the mixture ratio determining step abovementioned, by using the corresponding relationship between the high-density ink and the low-density ink, which are retained in the correspondence relationship retaining section 120, detailed later, while correlating them with the values of the mixture ratio dot profile.

A first halftone processing section 102*a* converts the correction data calculated by the controlling section 101, corresponding to one of recording materials being different from each other in density (low-density ink in the present embodiment), to dot data. Concretely speaking, the first halftone processing section 102*a* conducts the conversion processing for converting the correction data to 1-bit data representing ON or OFF status of the dot by comparing the threshold matrix stored in advance with the 8-bits correction data, corresponding to the inputted positional information of x-y coordinate. This method is called "Dither method" and various kinds of threshold matrixes, such as the Bayer type matrix, Blue noise type method, etc., can be employed in the present embodiment. However, the scope of the halftone method is not limited to the Dither method, but various kinds of other well-known halftone methods, such as the Error diffusion method the average error minimizing method, etc., can be applied to the halftone method. Further, since it is only possible in the present embodiment to select whether or not the first ink emission head emits the ink, the one-bit outputting mode is employed. However, depending on a kind of ink emission head, plural kinds of ink amounts can be emitted from the same head. In this case, it is applicable that a 2-3 bits multi-value halftone method can be employed depending on the kind of the ink emission head. According to the above, it becomes possible to select one of plural kind of ink amounts.

A second halftone processing section 102*b* converts the correction data calculated by the controlling section 101, corresponding to another one of the recording materials being different from each other in density (high-density ink in the present embodiment), to dot data. Concretely speaking, the first halftone processing section 102*a* conducts the conversion processing for converting the correction data to one-bit data representing ON or OFF status of the dot by comparing the threshold matrix stored in advance with the 8-bits correction data, corresponding to the inputted positional information of x-y coordinate. This method is called "Dither method" and various kinds of threshold matrixes, such as the Bayer type matrix, Blue noise type method, etc., can be employed in the present embodiment. However, the scope of the halftone method is not limited to the Dither method, but various kinds of other well-known halftone methods, such as the Error diffusion method, the average error minimizing method, etc., can be applied to the halftone method. Further, since it is only possible in the present embodiment to select whether or not the second ink emission head emits the ink, the one-bit outputting mode is employed. However, depending on a kind of ink emission head, plural kinds of ink amounts can be emitted from the same head. In this case, it is applicable that a 2-3 bits multi-value halftone method can be employed depending on the kind of the ink emission head. According to the above, it becomes possible to select one of plural kind of ink amounts.

A correspondence relationship retaining section 120 is constituted by various kinds of storage devices, such as a semiconductor memory, an HDD (Hard Disc Drive), etc., so as to retain correspondence relationships of inputted data versus high-density ink and low-density ink, taking the gradation correcting characteristic into consideration, corresponding to a mixture ratio of plural kinds of recording materials (mixture ratio dot profile).

A first-head driving section 130*a* drives a first ink emission head 140*a*, which includes a plurality of nozzles to emit one of the two kinds of recording materials, being different in density (low-density ink in the present embodiment), onto a recording paper sheet, so that the first ink emission head 140*a* emits the low-density ink according to the print data.

A second-head driving section 130*b* drives a second ink emission head 140*b*, which includes a plurality of nozzles to emit another one of the two kinds of recording materials, being different in density (high-density ink in the present embodiment), onto a recording paper sheet, so that the second ink emission head 140*b* emits the high-density ink according to the print data.

The first ink emission head 140*a* serves as a recording head, which includes a plurality of nozzles to emit one of the two kinds of recording materials, being different in density (for instance, low-density ink), onto the recording paper sheet, and is driven by the first-head driving section 130*a* so as to emit the low-density ink.

The second ink emission head 140*b* serves as another recording head, which includes a plurality of nozzles to emit another one of the two kinds of recording materials, being different in density (for instance, high-density ink), onto the recording paper sheet, and is driven by the second-head driving section 130*b* so as to emit the high-density ink.

A defect position detecting section 150 serves as a sensor to detect a defect position at which the recording material cannot be emitted among the plurality of nozzles included in each of the recording head (serving as a recording element) In this connection, although the defect position detecting section 150 detects the defect position by reading an image formed on the recording paper sheet in the present embodiment, the scope of the method is not limited to the abovementioned. As set forth in Tokkaihei 2003-205602 (Japanese Non-Examined Patent Publication), it is also applicable that an optical sensor is employed for detecting presence or absence of the ink emission corresponding to pass through or shut off of the light, while making the plurality of nozzles sequentially emit ink one by one at predetermined intervals.

Figure 2:
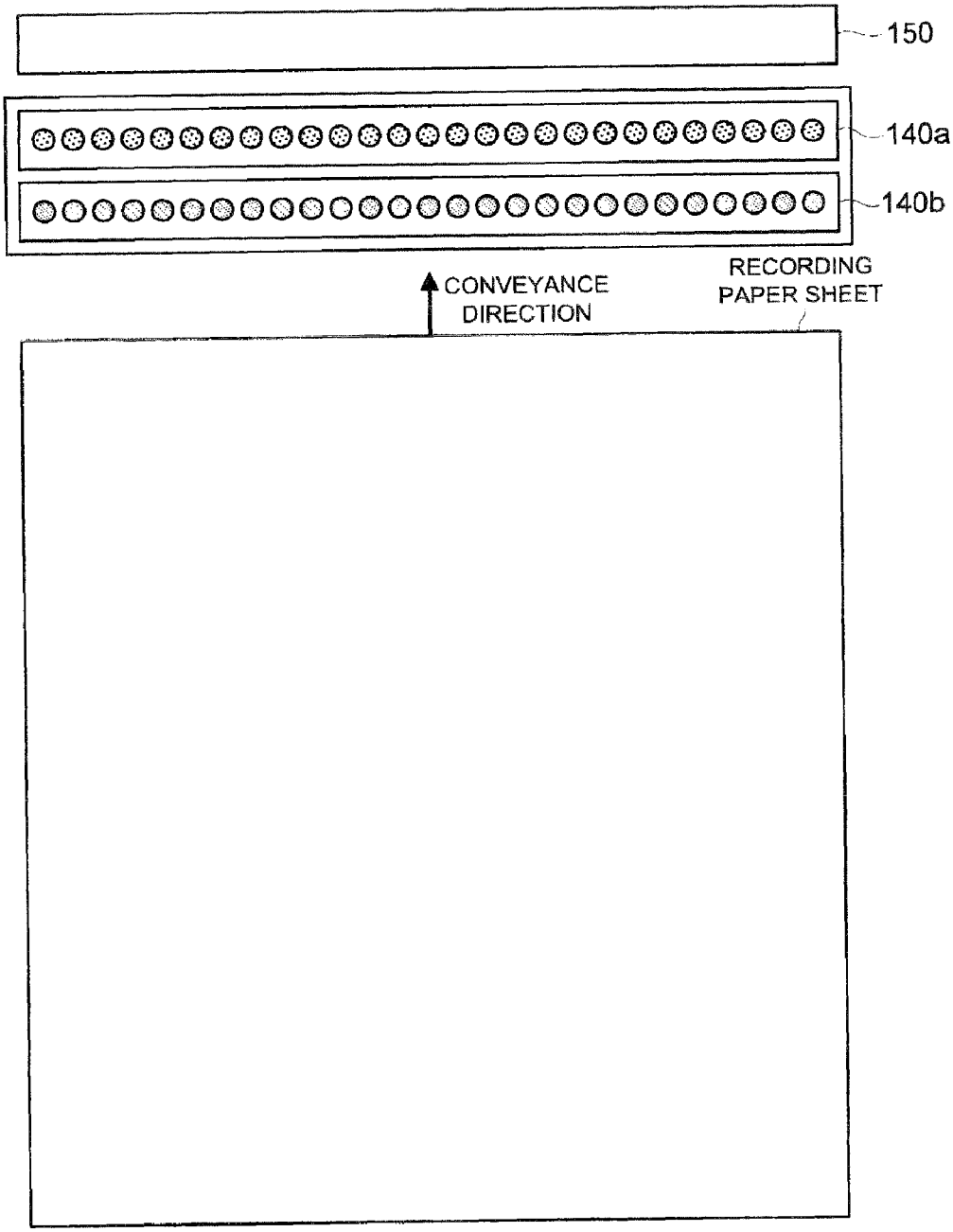
FIG. 2 shows an explanatory schematic diagram indicating an arrangement of recording elements employed in an image forming apparatus embodied in the present invention.

In this connection, for instance, the first ink emission head 140*a*, the second ink emission head 140*b* and the defect position detecting section 150 are arranged according to the positional relationship, for instance, as shown in FIG. 2. In this arrangement of the present embodiment, the plurality of nozzles of each of the recording heads are aligned linearly in a direction orthogonal to a conveying direction of the recording paper sheet, so that an image is formed on the recording paper sheet by emitting recording materials from the nozzles of each recording head fixed onto the apparatus, while moving the recording paper sheet in the conveying direction (down-to-up direction as indicated by the arrow shown in FIG. 2). A defect position detecting section 150 serves as a line scanner and is disposed at a position located downstream the conveying direction, so that the line scanner can specify the defect position immediate after a test chart is formed on the recording paper sheet. In this connection, it is also applicable such a structure that the recording paper sheet is put on the apparatus stationary, while moving the recording head over the recording paper sheet.

A defect position identifying section 160 identifies a position of a defect nozzle that resides at the defect position detected by the defect position detecting section 150 among the plurality of nozzles (recording element) and a kind of ink concerned (recording material).

When determining the mixture ratio of the plural kinds of recording materials belonging to the same color category but being different in density, a mixture ratio determining section 170 determines the mixture ratio information of the high-density ink and the low-density ink for the nozzle position information (positional information of x), so as to make the mixture ratio of the ink, to be emitted by plural nozzles residing at the defect position specified by the defect position specifying section 160 and in the peripheral area of the defect position, decrease lower than that of the normal state, while using the normal mixture ratio for the other nozzles residing in the other area.

Figure 3:
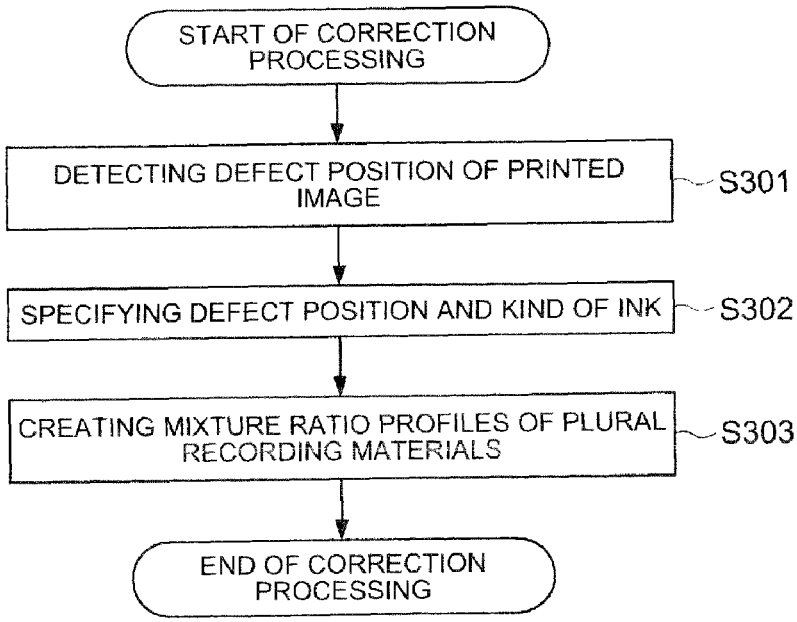
FIG. 3(*a*) and FIG. 3(*b*) show flowcharts indicating operating procedures to be conducted in an image forming apparatus embodied in the present invention.
Figure 3:
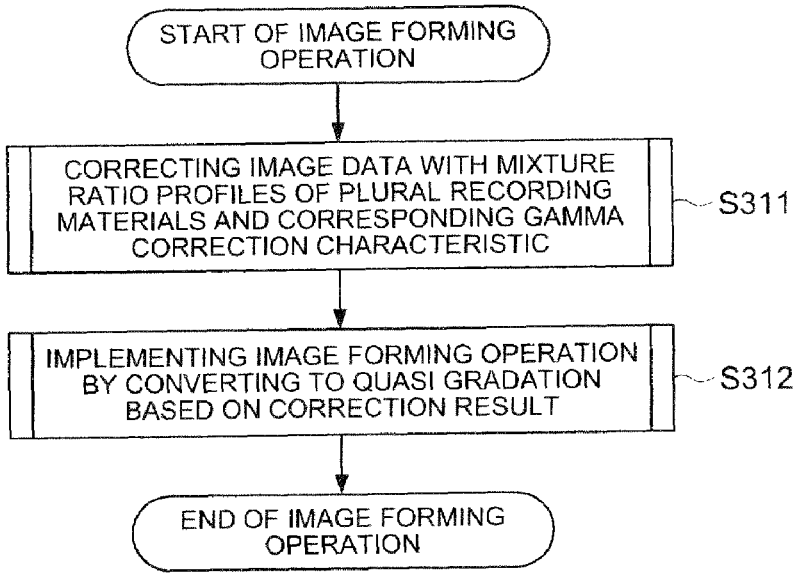

FIG. 3 shows a flowchart indicating operating procedures to be conducted in the image forming apparatus 100 embodied in the present invention. At first, a controlling section 101 starts the correction processing (shown in FIG. 3(*a*)). Then, the defect position detecting section 150 detects the defect position at which a certain defect nozzle among the plurality of nozzles included in each of the recording heads does not emit the ink (Step S301 shown in FIG. 3(*a*)).

For this purpose, under the controlling actions conducted by the controlling section 101, a solid color image having a uniform density are formed on the recording paper sheet by making all of the nozzles emit ink droplets onto the paper sheet concerned, and then, the defect position detecting section 150 reads the solid color image formed on the recording paper sheet, so as to detect a position, at which a reflectance is high (density is low) compared to that of other positions, as the defect position (refer to the graph shown in FIG. 4) In this connection, although the reflectance is employed as a parameter representing the density in the above embodiment, the scope of the parameter is not limited to the reflectance, any other parameter that represents the density, such as brightness, etc., may be employed for this purpose. As detailed later, according to the present invention, it is not necessary to accurately locate the position of the defected nozzle. Accordingly, it becomes possible to employ such a line scanners resolution of which is coarser than the nozzle arranging resolution, resulting in a cost decrease of the image forming apparatus as a whole.

Alternatively, it is also applicable that, by making the nozzles included in the recording head sequentially emit ink droplets one by one at predetermined time intervals, an optical sensor is utilized for detecting presence or absence of the ink emission corresponding to pass through or shut off of the light beam emitted from a light source (light emitting element).

Figure 4:
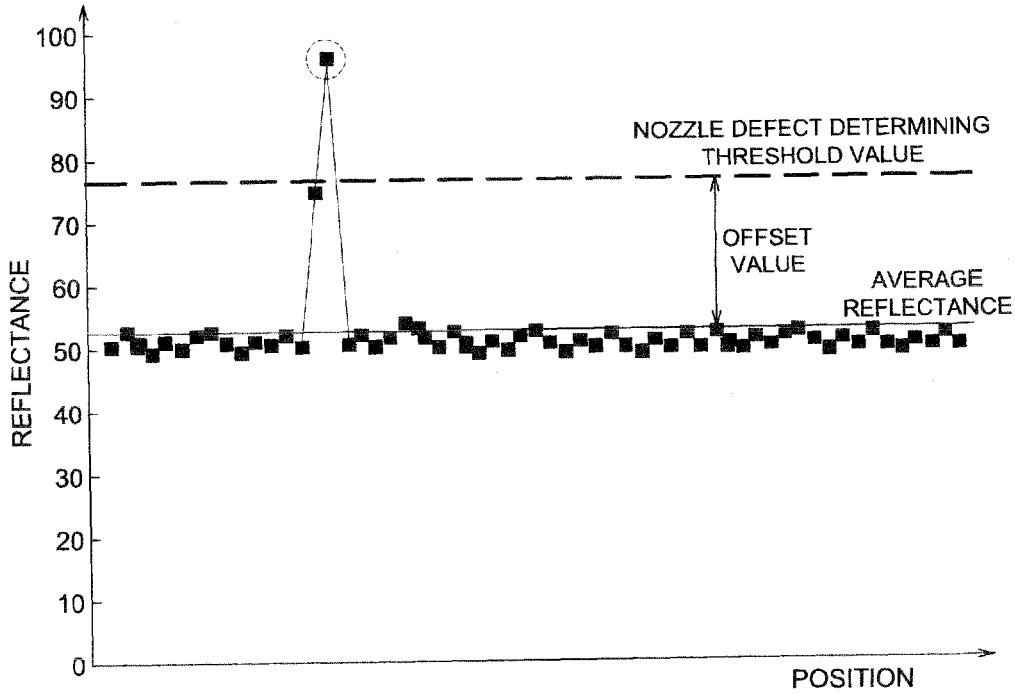
FIG. 4 shows a graph representing a reflectance distribution in a width direction of a recording paper sheet.

Successively, the defect position specifying section 160 specifies the nozzle position and the kind of ink, both corresponding to the defect position detected by the defect position detecting section 150 (Step S302 shown in FIG. 3(*a*)). FIG. 4 shows a graph representing a reflectance distribution in a width direction of the recording paper sheet, when every one of all nozzles emits an equivalent amount of ink droplets onto the recording paper sheet. When reflectance of the image, formed by making all nozzles emit equivalent ink droplets onto the recording paper sheet, are measured, ideally, uniform reflectance all over the image should be revealed on the graph. However, if a certain nozzle is defected, the reflectance would drastically change at a position of the defected nozzle, since the defected nozzle cannot emit any ink droplets onto the position. The defect position specifying section 160 determines the position, at which the reflectance drastically changes, as the defect position.

Concretely speaking, an average reflectance over the reflectance acquired in the width direction of the recording paper sheet is calculated, so as to establish a value derived by adding an offset value to the average reflectance as a defect determining threshold value. Then, the defect position specifying section 160 determines a region, in which the reflectance is higher that the defect determining threshold value, as the defect position. In this connection, the reason why the offset value is added to the average reflectance is to eliminate the influence of the measuring noises generated by the line scanner. According to the measuring results, it is desirable that the offset value is in a range of ⅕-⅙ of the reflectance difference between the average reflectance and the reflectance of the recording medium concerned. Further, the defect position specifying section 160 specifies the defect position for every color by conducting the abovementioned process for every ink emission head. With respect to the defect position specifying results in the first embodiment, the defect information of the high-density ink emission head is defined as D_nozzle_lack[n], while the other defect information of the low-density ink emission head is defined as L_nozzle _ lack[n] and both of them are stored in an arranging memory. In the above nozzle arrangements, [n] indicates a numeral representing a position in the width direction of the recording paper sheet, and when determining that defect is present at a position represented by numeral [n], "1" is stored, while when determining that defect is absent at a position represented by numeral [n], "0" is stored.

When determining the mixture ratio of the plural kinds of recording materials belonging to the same color category but being different in density, the mixture ratio determining section 170 decreases the mixture ratio of the ink, to be emitted by plural nozzles residing at the defect position specified by the defect position specifying section 160 and in the peripheral area of the defect position, lower than that of the normal state, while employing the normal mixture ratio for the other nozzles residing in the other area, so as to determine the mixture ratio according to the print data representing the image to be recorded (Step S303 shown in FIG. 3(*a*)).

Figure 5:
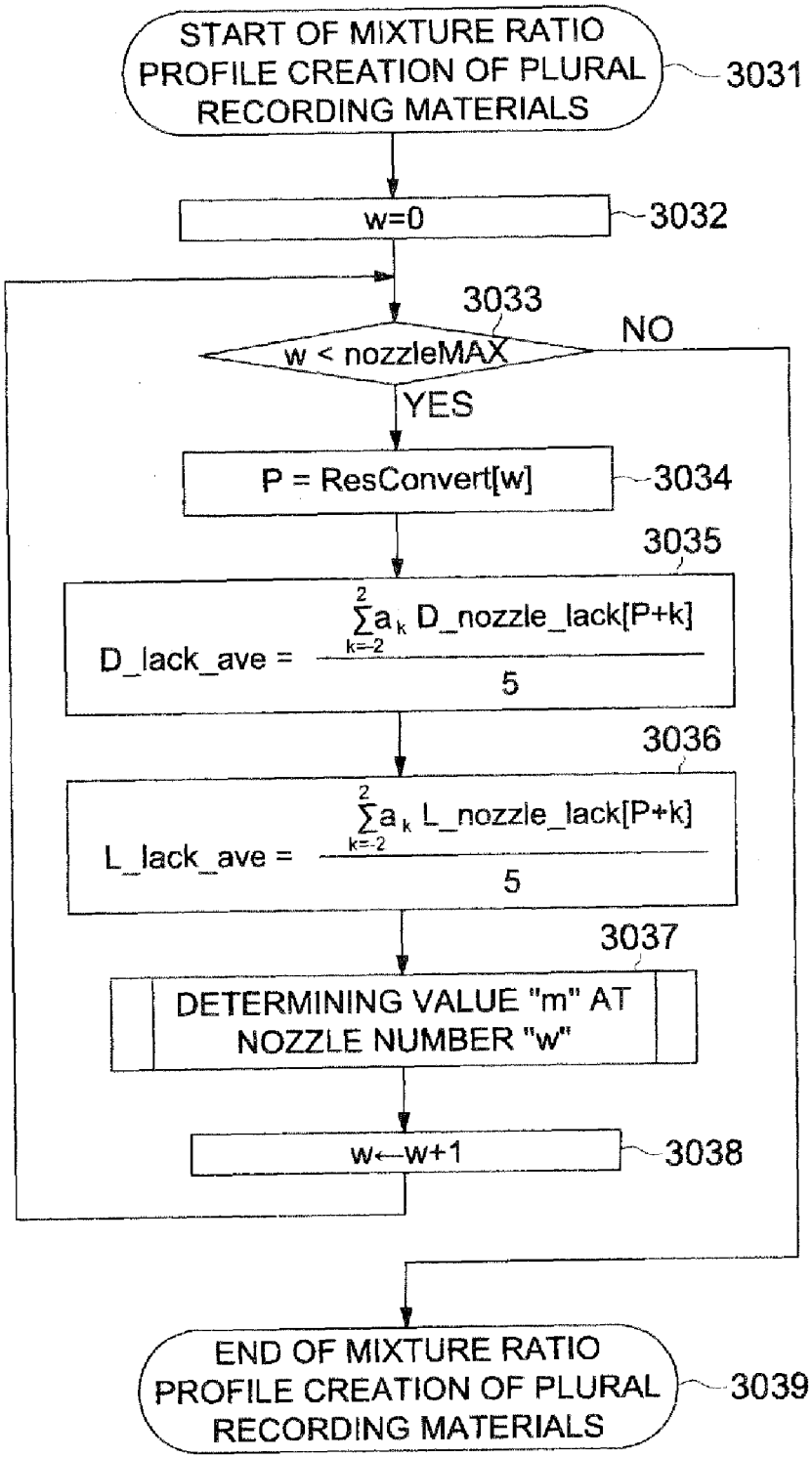
FIG. 5 shows a flowchart indicating operating procedures to be conducted in Step S303 shown in FIG. 3(*a*)

Referring to FIG. 5, Step S303 shown in FIG. 3(*a*) Will be detailed in the following. At first, the nozzle is set at 0 (Step S3032). Then, a profile creation processing, described in the following, is repeated until numeral "w" reaches to "nozzleMax" (Step S3033). The "nozzleMax" represents a number of nozzles provided in the ink emission head currently used. Successively, the nozzle position is converted to a function of the defect position (Step S3034). Step S3034 is a correction processing to be conducted when the resolution of the line scanner that acquires the defect position does not match with the arranging resolution of the nozzles. For instance, when the nozzle arranging resolution is 730 dpi while the resolution of the line scanner is 360 dpi, "P" can be set at integer of "W/2".

Successively, with respect to the nozzle defect information acquired in Step S302, a defect weighted moving average of the five peripheral positions is calculated for each of the high-density head and the low-density head, so as to substitute the defect weighted moving averages for D_lack_ave and L_lack_ave, respectively. With respect to the both edge regions in each of which no nozzle defect information exist, the average processing is conducted by substituting "0" (Step S3035 and Step S3036). Although the five peripheral positions are employed for calculating the defect weighted moving average in the above, it is also applicable that the number of positions to be averaged is variable corresponding to the nozzle arranging resolution. Since an abrupt change of the gradation in a narrow space is liable to be recognized as a tone discontinuity, it is preferable that the higher the nozzle arranging resolution is, the greater the number of the nozzle positions to be averaged (averaging nozzle number) is made. After that, based on the values of D_lack_ave and L_lack_ ave, value "m" for calculating the variable density ratio is determined for each of the nozzle numbers (Step S3037). The above process is repeated by sequentially adding "1" to "w" in Step S3038, until "w" reaches to "nozzleMax". At the time when w=nozzleMax is fulfilled, the creation of the mixture ratio profile is finalized.

Figure 6:
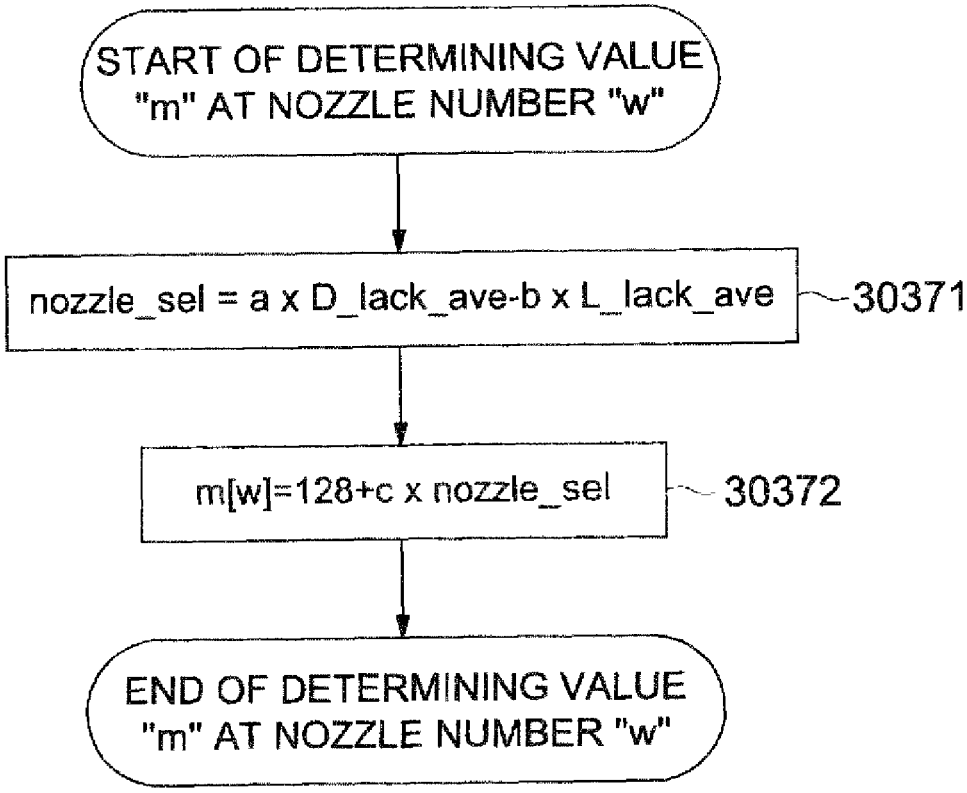
FIG. 6 shows a flowchart indicating operating procedures to be conducted in Step S3037 shown in FIG. 5.

Referring to FIG. 6, Step S3037 will be further detailed in the following. The nozzle_sel represents a parameter for giving a priority to either the high-density ink or the low-density ink when selecting them. In this example, D_lack_ave and L_lack_ave are weighted, and then, the difference between the weighted D_lack_ave and the weighted L_lack_ave is established as the nozzle_sel (Step S30371). Numerals "a" and "b" are employed as the weighted coefficients for the above. Although "a"="b" is applicable in the above example, generally speaking, by giving the priority to the high-density ink, the total number of dots can be reduced, and as a result, the defects become unrecognizable. Therefore, by setting the weighted coefficients as "a">"b">0, it becomes possible to make the defects unrecognizable, since the printing process is implemented under such a setting that the high-density ink is used prior to the low-density ink, when the number of defects residing in the high-density ink emission head is equal to those residing in the low-density ink emission head.

Still successively, profile m[n] ("n" represents a nozzle number) is created by employing the nozzle_sel abovementioned (Step S30372). In this example, the reference value, to be employed at the time when no defect exists, is established as 128. Concretely speaking, when no defect exists at the position concerned (D_lack_ave=L_lack_ave=0), the nozzle_sel becomes zero (nozzle_sel=0), and as a result, m[w]=128 is substituted. On the other hand, when a nozzle defect is exist at position "w" only in the high-density ink emission head (nozzle_sel>0), nozzle_sel becomes larger than zero (nozzle_sel>0), and as a result, m[w] becomes larger than 128 (m[w]>128) and the usage ratio of the high-density ink decreases. Conversely, when a nozzle defect is exist at position "w" only in the low-density ink emission head (nozzle_sel>0), m[w] becomes smaller than 128 (m[w]<128) and the using ratio of the low-density ink decreases. Further, with respect to the region in which both the low-density ink emission head and the high-density ink emission head have nozzle defects, since the weighting coefficients are established according as "a">"b">0, m[w] becomes larger than 128 (m[w]>128). In this case, the variable density ratio is selected to such a value that gives a priority to the usage of the high-density color. Since it is possible to reduce the dot ratio over the whole gradation by increasing the ratio of high-density color, it becomes possible to make the defects hardly perceptible. The coefficient "c" shown in Step S30372 is used for determining the variable rate of the variable density ratio versus nozzle defect. By increasing the value of coefficient "c", it becomes possible to increase the effect for suppressing the emergence of defects, caused by the nozzle defects, out of the created image. However, if coefficient "c" is set at excessively larger value, the granularity is getting worse in the region in which the high priority is given to the usage of the high-density color, while the color density is getting decrease in the region in which the high priority is given to the usage of the low-density color. It is applicable that coefficient "c" is a changeable value, which can be changed corresponding to the density ratio of the high-density ink and the low-density ink. For instance, when the density ratio of the high-density ink and the low-density is relatively small, it is possible to increase the value of coefficient "c". In the present embodiment, since the density ratio of the high-density ink and the low-density is set at "1:3", coefficient "c" is established as 40 (c=40).

Figure 7:
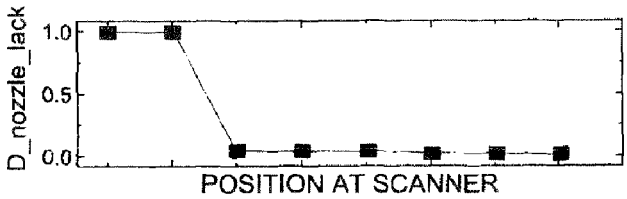
FIG. 7(*a*), FIG. 7(*b*), FIG. 7(*c*), FIG. 7(*d*), FIG. 7(*e*), FIG. 7(*f*), FIG. 7(*g*) and FIG. 7(*h*) show examples of the mixture ratios to be determined by a mixture ratio determining section of an image forming apparatus embodied in the present invention.
Figure 7:
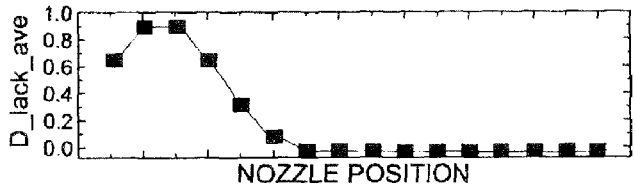
Figure 7:
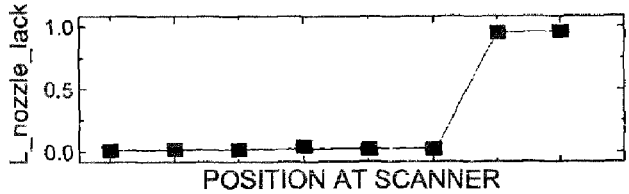
Figure 7:
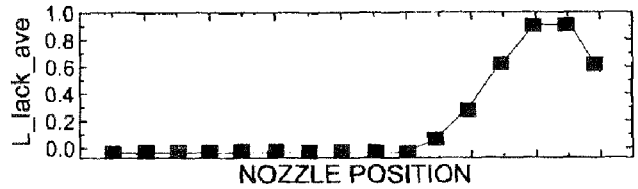
Figure 7:
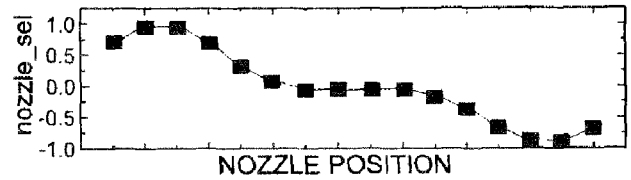
Figure 7:
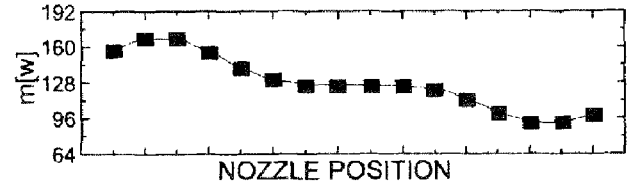
Figure 7:
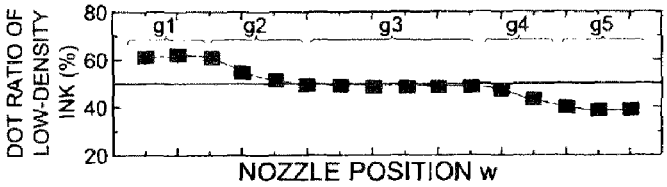
Figure 7:
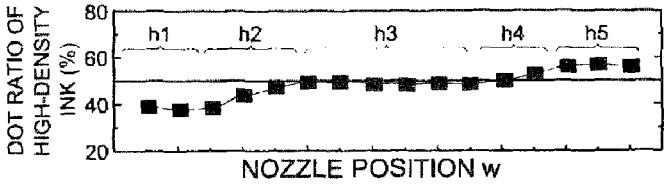

FIGS. 7(*a*) through 7(*h*) show examples of the mixture ratios to be determined by the mixture ratio determining section 170. FIG. 7(*a*) shows defect information D_nozzle_lack created by the first ink emission head 140*a* that emits the high-density ink, while FIG. 7(*c*) shows defect information L_nozzle_lack created by the second ink emission head 140*b* that emits the low-density ink. Further, FIG. 7(*b*) and FIG. 7(*d*) can be obtained by applying the resolution conversion processing and calculating the weighted moving average values with respect to each of the D_nozzle_lack and the L_nozzle_lack. FIG. 7(*b*) and FIG. 7(*d*) corresponds to the first ink emission head 140*a* and the second ink emission head 140*b*, respectively. Further, since values on the horizontal axis are converted to the nozzle positions, instead of the scanner positions, the number of plots represented by data is doubled of those shown in FIG. 7(*a*) and FIG. 7(*c*), respectively. In the present embodiment, the weighted coefficients to be employed in the weighted average process (Step S3035, Step S3036) are established as $a_{-1}=a_1=0.7$, $a_{-2}=a_2=0.3$ and $a_0=1.0$. Further, FIG. 7(*e*) shows values of nozzle_sel versus nozzle positions, which are derived by adding while setting "a"=1.1 and "b"=0.9 in Step S30372 shown in FIG. 6. Still further, FIG. 7(*f*) shows a graph derived by multiplying the nozzle_sel by the coefficient, and then, by adding 128, serving as the reference value, to the multiplied nozzle_sel. Still further, FIG. 7(*g*) and FIG. 7(*h*) show graphs representing recording ratios of the high-density ink and the low-density ink at the predetermined density, respectively. In this connection, to make the explanation easy, in this example, here is indicated changing characteristics at density representing the high-density ink and the low-density ink with 50% when no nozzle defect exist. As shown in FIG. 7(*g*) and FIG. 7(*h*), since no nozzle defect exist in both regions g3 and h3, the reference value is inputted with respect to both the high-density ink emission head and the low-density ink emission head. Accordingly, since the equation of m[w]=128 is established in both regions g3 and h3, the dot ratio of both the high-density ink and the low-density ink become 50%.

Further, only the first ink emission head 140*a* has a defect in the regions g1 and h1. In this case, as found from the graph shown in FIG. 7(*f*), m[w]=128 is established When decomposing the gradation values into the dot ratios, there is applied such a decomposing table that represents the gradation with using the low-density color more than the high-density color by delaying the initial introduction timing of the high-density ink. Accordingly, since the usage of the low-density color overrides that of the high-density color to represent the same density as indicated in the regions g1 and h1, the defect hardly appears on the printed image. On the other hand, only the second ink emission head 140*b* has a defect in the regions g5 and h5. In this case, as found from the graph shown in FIG. 7(*f*), m[w]<128 is established. In other words, when decomposing the gradation values into the dot ratios, there is applied such a decomposing table that represents the gradation with using the high-density color more than the low-density color by advancing the initial introduction timing of the high-density ink. Accordingly, since the usage of the high-density color overrides that of the low-density color to represent the same density as indicated in the regions g5 and h5, the defect hardly appears on the printed image, as well. Further, the regions g2, g4, h2 and h4 are transient regions connecting the defect occurring regions and the normal state regions to each other. As shown in FIG. 7(*g*) and FIG. 7(*h*), by continuously changing the dot ratios, instead of abruptly changing the dot ratios corresponding to the nozzle defect positions, it becomes possible to fill the spaces between the defect occurring regions with the naturally changing curves.

According to the abovementioned method, it becomes possible not only to suppress the occurrence of the tone discontinuity and prevent the occurrence of the white line, but also to fill the spaces between the correction region, in which the occurrence of the white line should be prevented, and the non-correction region, to which no processing is applied, with the naturally changing curve.

In this connection, another method for determining the mixture ratio will be detailed in the following.

Figure 8:
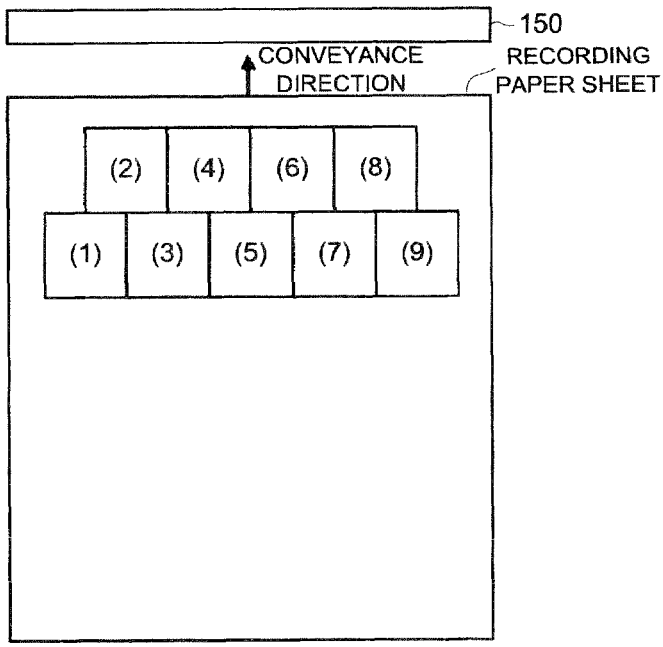
FIG. 8(*a*) shows a concrete example in which a surface area of a recording paper sheet is divided into 9 regions in such a manner that divided regions overlap with each other half by half in a nozzle arranging direction.
Figure 8:
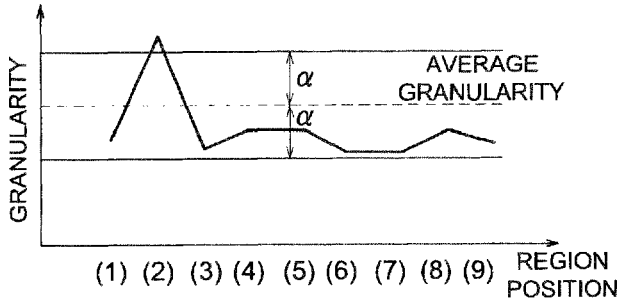
Figure 8:
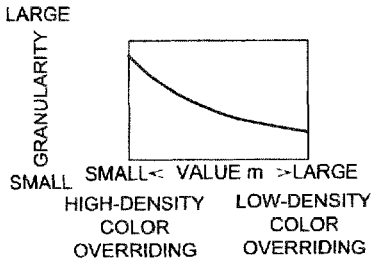
Figure 8:
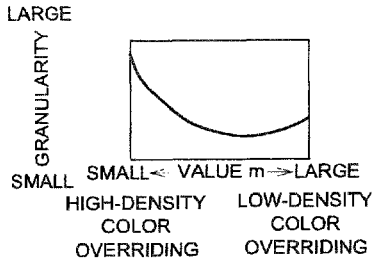

As shown in FIG. 8(*b*), the surface area of the recording paper sheet, on which an image is already formed, is divided into a certain number of regions, so as to measure the granularity (sense of noise) within each of the divided regions by employing the line scanner. FIG. 8(*b*) shows a concrete example in which the surface area of the recording paper sheet is divided into 9 regions in such a manner that the divided regions overlap with each other half by half in the nozzle arranging direction orthogonal to the conveyance direction of the recording paper sheet.

In the present embodiment, the granularity is found by using the evaluating Equation indicated as follow.

$$\text{Granularity} = a(L^*)\int\sqrt{WS(u)}\cdot VTF(U)du$$

$$VTF(u) = 5.05\ \exp\left(-0.138\frac{\pi lu}{180}\right)\left\{1-\exp\left(-0.1\frac{\pi lu}{180}\right)\right\}$$

$$a(L^*) = \left(\frac{L^*+16}{116}\right)^{0.8}$$

where u: spatial frequency,

WS (u): Wiener spectrum of the reflection density fluctuation of the image concerned, VTF(u): Visual transfer function serving as the spatial frequency characteristic of visual sense, detailed later, and a(L*): Correction coefficient.

In the VTF function, "π" represents the ratio of the circumference of a circle to its diameter, while "1" represents the sight distance. Further, in the correction coefficient a(L*), L* represents the average brightness at the measuring objective image. The details of the above are set forth in the non-patent document titled "Noise Perception In Electro-photography" (written by Dooly & Shaw, J. Appl. Photogr. End., PP 190-196 (1976)).

When assuming that the granularities of the divided regions shown in FIG. 8(*b*) are found as the values indicated in the graph shown in FIG. 8(*b*), respectively, by taking each of the granularities of the divided regions into account, in addition to the mixture ratio determined in the above, the numeral m[w] is adjusted so as to make a specific granularity, which is protruded from the average level of the whole granularities, fall into a range of a constant value (average value ±α). This is because, a partial change of the granularity is result in a visible streak shaped in a kind of band. Accordingly, with respect to such a region that has an extremely large granularity or an extremely small granularity, it is necessary to reestablish the mixture ratio concerned. The value α, serving as an indicator of an allowable range of the granularity, varies depending on the measuring methods. In the present embodiment, ⅕ of the average value of the whole granularities is employed as the value α. FIG. 8(*c*) shows a graph indicating a relationship between the granularity and the value "m", representing the mixture ratio of high and low density colors. As indicated by the graph, since the usage of the low-density ink overrides that of the high-density ink when increasing the value "m", the granularity of the region concerned can be reduced. Accordingly, when the granularity exceeds the upper limit of the predetermined range, the value "m" is made larger, while, conversely, when the granularity is lower than the lower limit vale of the predetermined range, the value "m" is made smaller, so as to raise the granularity.

With respect to the operation for optimizing the value "m", which employs the granularity, another example will be detailed in the following. FIG. 8(*d*) shows a graph indicating a transition curve of the granularity versus the value "m", when a nozzle defect exists in the low-density ink emission head. As indicated by the graph shown in FIG. 8(*d*), according as making the value "m" increase, the granularity gradually decreases until the value "m" reaches to a certain value, and then, the granularity gradually increases in the range of the value "m" being larger than the certain value abovementioned. Primarily, by making the value "m" increase, the granularity should decrease associated with the increase of the value "m" since the usage of the low-density ink overrides that of high-density ink. However, in case that the nozzle defect occurs in the low-density ink emission head, when the usage frequency of the low-density ink emission head increases up to a predetermined level or a higher level, a defect in the created image, caused by the nozzle defect, tends to be easily recognize. Therefore, it can be considered that the transition curve of the granularity shown in FIG. 8(*d*) is due to the abovementioned reasons. Accordingly, when the nozzle defect exists at the position at which the granularity is measured in the low-density ink emission head, it is applicable that the value "m" on the position concerned is determined as such a value "m" that makes the granularity minimum It is preferable that the timing to implement the granularity correction processing abovementioned is set at such a time after the mixture ratio profile is created in Step S303. By measuring the granularity distribution of density, which is acquired by attaching the equivalent amount of high-density dots and low-density dots based on the mixture ratio profile created in the above, in the width direction of the recording paper sheet, it is possible to correct a part in which the value "m" has been excessively fluctuated in Step S303.

As mentioned in the foregoing, by correcting the result of the processing for eliminating the defect in view of the granularity, it becomes possible to form a higher quality image, compared to that formed in the conventional method.

Then, referring to the mixture ratio determined by the mixture ratio determining section 170 corresponding to the defect concerned, and the correspondence relationship of the gradation correction characteristic corresponding to the mixture ratio retained by the correspondence relationship retaining section 120, the controlling section 101 conducts controlling actions so that image forming operation is conducted by employing the gradation correction characteristic corresponding to the mixture ratio determined in the above.

In this connection, a concrete method for determining the gradation correction characteristic, based on both the mixture ratio determined by the mixture ratio determining section 170 and the correspondence relationship retained by the correspondence relationship retaining section 120, will be detailed in the following.

Figure 9:
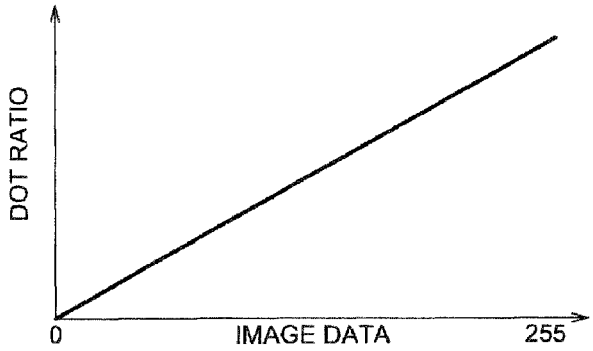
FIG. 9(*a*), FIG. 9(*b*), FIG. 9(*c*) and FIG. 9(*d*) show graphs indicating various examples of variable density decomposing tables.
Figure 9:
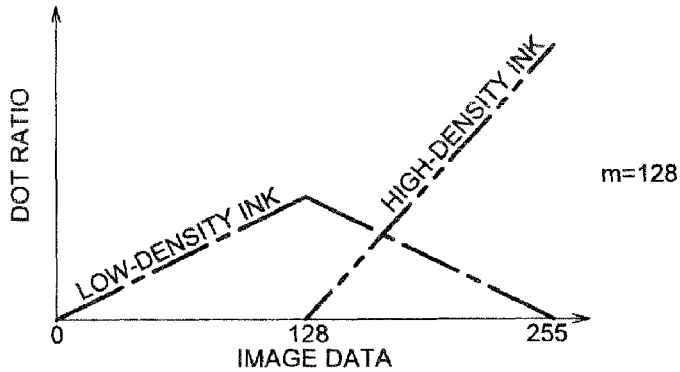
Figure 9:
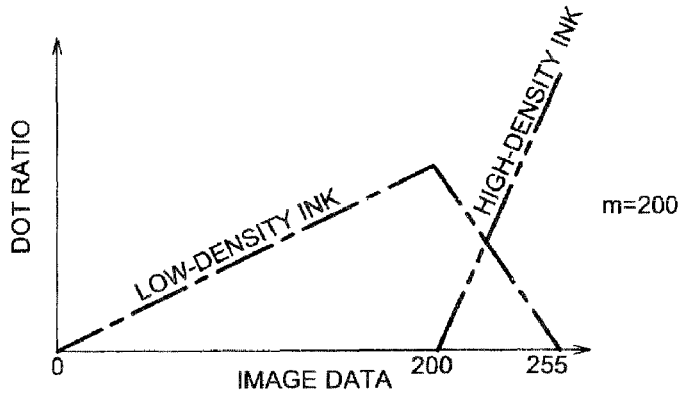
Figure 9:
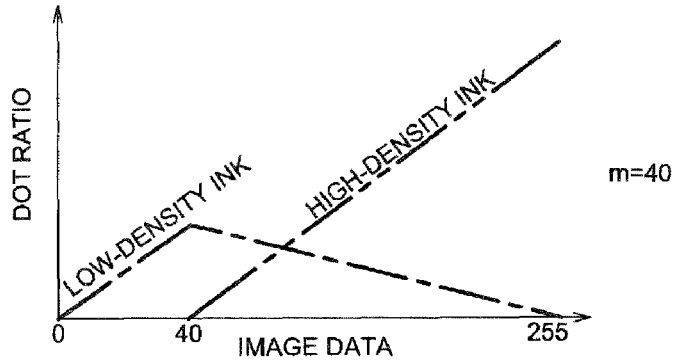

In each of the characteristic graphs shown in FIGS. 9(*a*) through 9(*d*), the horizontal axis represents signal values of the image data (0-255), while, the vertical axis represents dot ratios. Specifically, the graph shown in FIG. 9(*a*) indicates such a case that the image forming operation is implemented by emitting one kind of ink, and the dot ratio is in proportion to the value of the image data.

Further, when a combination of the high-density ink and the low-density ink is employed for the image forming operation, it is possible to change its using status and to create a variable density decomposing table. The graph shown in FIG. 9(*b*) indicates such a case that the image forming operation is implemented by emitting two kinds of inks (high-density ink and low-density ink), and in this case, only the low-density ink is increasingly emitted in a range of the signal values 0-127, and then, the high-density ink is increasingly emitted while the low-density ink gradually decreases in a range from the signal values 128, being a half of 256 stages, to the signal values 225, as indicated by the graph.

Still further, the graph shown in FIG. 9(*c*) indicates such a case that the image forming operation is implemented by emitting two kinds of inks (high-density ink and low-density ink), and in this case, only the low-density ink is increasingly emitted in a range of the signal values 0-199, and then, the high-density ink is increasingly emitted while the low-density ink gradually decreases in a range from the signal values 200 to the signal values 225, as indicated by the graph The case shown in FIG. 9(*c*) corresponds to such a state in which the mixture ratio of the high-density ink decreases to a lower level, compared to the case shown in FIG. 9(*b*).

Still further, the graph shown in FIG. 9(*d*) indicates such a case that the image forming operation is implemented by emitting two kinds of inks (high-density ink and low-density ink), and in this case, only the low-density ink is increasingly emitted in a range of the signal values 0-39, and then, the high-density ink is increasingly emitted while the low-density ink gradually decreases in a range from the signal values 40 to the signal values 225, as indicated by the graph. The case shown in FIG. 9(*c*) corresponds to such a state in which the mixture ratio of the low-density ink decreases to a lower level, compared to the case shown in FIG. 9(*b*).

In the present embodiment, the gradation area from which the high-density ink starts to be mixed is retained as the variable density mixture ratio profile "m". The decomposing pattern of "m=128", serving as a reference in the present embodiment, corresponds to the graph shown in FIG. 9(*b*).

Further, the variable density decomposing tables respectively shown in FIG. 9(*b*), FIG. 9(*c*) and FIG. 9(*d*) are calculated by employing the Equations as follows. When a dot ratio of the high-density ink, a dot ratio of the low-density ink and a dot ratio of 100% are defined as D_RATE, L_RATE and 255, respectively, the following Equations can be represented.

0<"image data"<m $$D_RATE=0$$

$$L_RATE=\text{"image data"}$$

m<"image data"<255

$$D_RATE=255\times(\text{"image data"}-m)/(255-m)$$

$$L_RATE=\text{"image data"}-D_RATE$$

Figure 10:
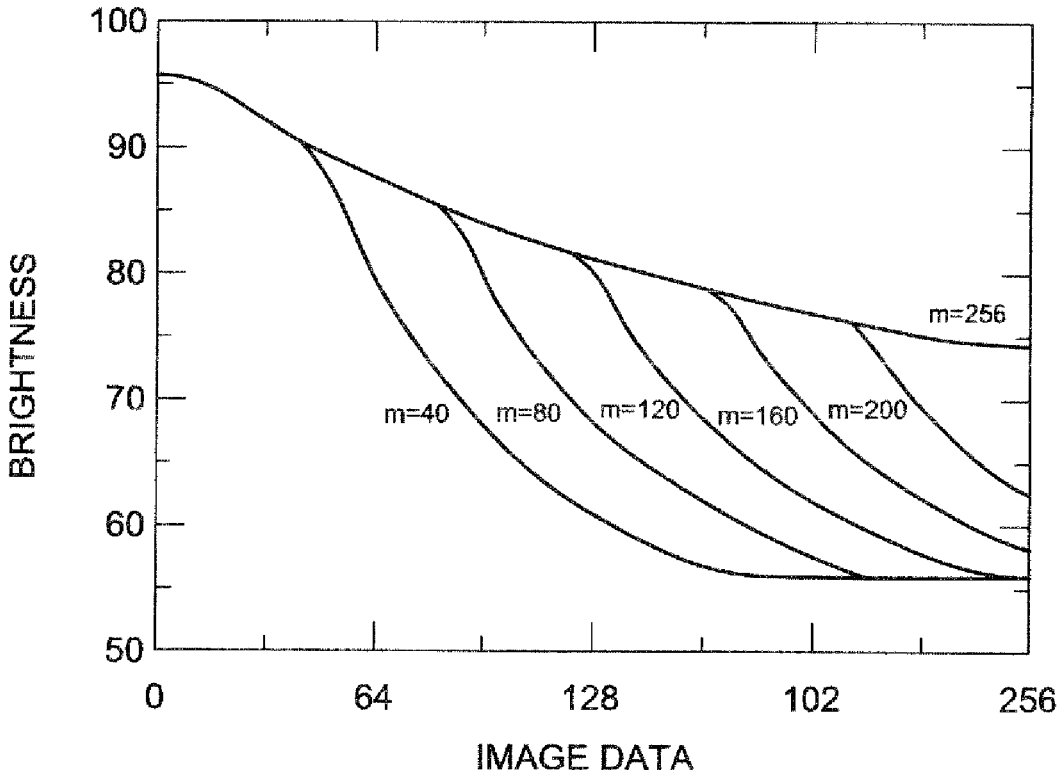
FIG. 10 shows a graph indicating a characteristic chart indicating brightness measuring results of gradation characteristics.

Further, FIG. 10 shows a graph indicating a characteristic chart indicating the brightness measuring results of the gradation characteristics. This characteristic chart is acquired by plotting the results of measuring the brightness of the printed image formed on the recording paper sheet by using dots of the high-density ink and the low-density ink shared by the inputted image data (0-255), based on the variable density decomposing table in respect to the value "m" abovementioned. Concretely speaking, the chart shown in FIG. 10 Indicates brightness transition lines corresponding to various kinds of values "m", such as "m=256" (only using low-density ink), "m=200" "0"—"low-density ink: 200"—"high-density ink") "m =160" ("0"—"low-density ink: 160"—"high-density ink"), "m=120" ("0"—"low-density ink: 120"—"high-density ink"), "m=80" ("0"—"low-density ink: 80"—"high-density ink") and "m=40" ("0"—"low-density ink: 40"—"high-density ink").

Figure 11:
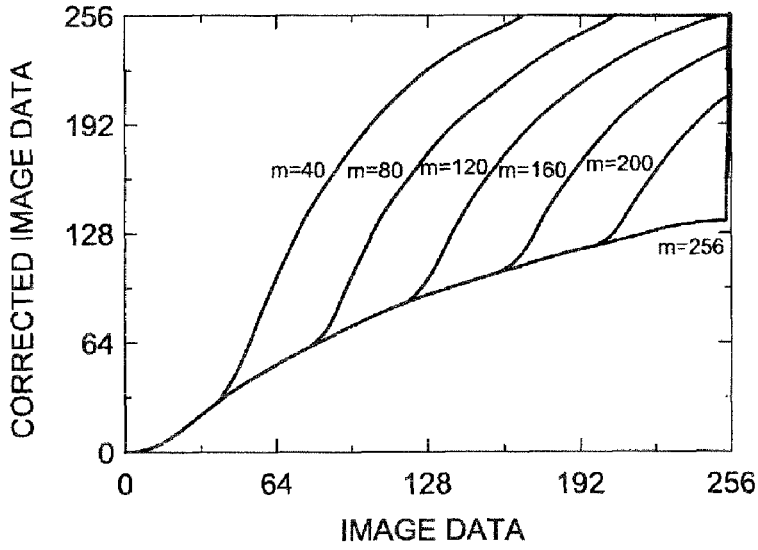
FIG. 11 shows a graph created from the characteristic chart shown in FIG. 10, indicating gradation correction curves to be used for linearizing brightness changes versus inputted image data.

FIG. 11 shows a graph created from the characteristic chart shown in FIG. 10, which indicates gradation correction curves to be used for linearizing the brightness changes versus the inputted image data. By employing the gradation correction curves shown in FIG. 11, the image data is converted to the corrected image data. This gradation correction curves can be obtained by processing the chart shown in FIG. 10 as follow. At first, with respect to the chart shown in FIG. 10, the values of brightness from the maximum value to the minimum value are allotted to values of image data from 0 to 255, respectively. Then, the axis representing the gradation data and that representing the brightness are replaced with each other. According to the abovementioned process, the gradation correction curves shown in FIG. 11 can be obtained. In this chart, the gradation correction curves corresponds to the variable density decomposing tables of "m=256", "m=200", "m=160", "m=120", "m=80" and "m=40", respectively.

Figure 12:
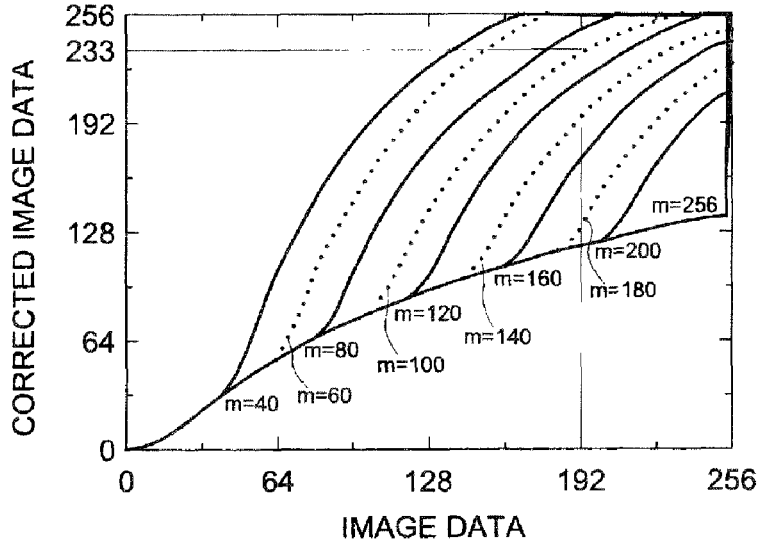
FIG. 12 shows a graph indicating predicted intermediate curves in respect to intermediate values "m" respectively residing between adjacent two of gradation correction curves shown in FIG. 11.

As found from the gradation correction curves shown in FIG. 11, it can be recognized that a kind of regularity exists in the changes of the correction curves versus the values "m". This is caused by the fact that the variable density decomposing tables abovementioned are created regularly (in the present embodiment, employing the Equation). By using the above regularity, intermediate curves in respect to intermediate values "m" respectively residing between adjacent two of the gradation correction curves obtained in respect to the discrete values "m" as shown in FIG. 11 are predicted and plotted on a chart shown in FIG. 12. In the chart shown in FIG. 12, the gradation correction curves in respect to "m=60", "m=100", "m=140" and "m=60" are calculated from the curve in respect to "m=40" shown in FIG. 11. In other words, the above fact reveals that, if only a single gradation correction curve exists, it is possible to obtain various gradation correction curves in respect to continuously changing values "m" from the single gradation correction curve. In the present embodiment, the gradation correction curves in respect to all of the integers from "m=0" to "m=150" are calculated and retained as the gradation correction LUTs (Look Up Table) for values "m". In this connection, the reason why the range of the values "m" is set as "m≦150" in the above is that it is possible to acquire a sufficient maximum density if the value "m" is in the abovementioned range.

Figure 13:
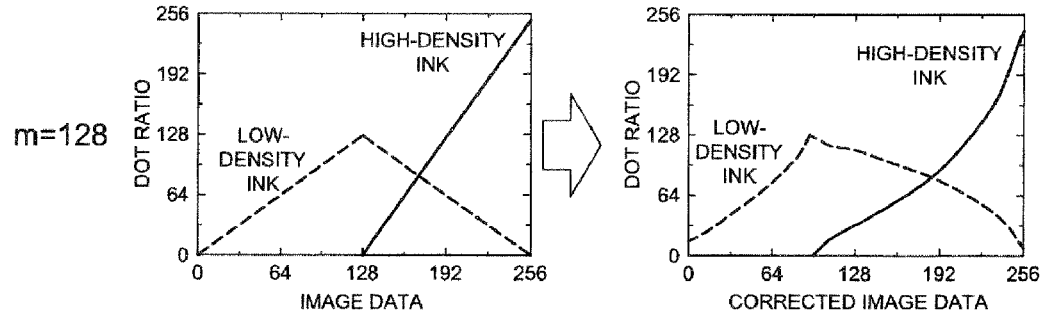
FIG. 13(*a*), FIG. 13(*b*) and FIG. 13(*c*) show explanatory graphs indicating the variable density decomposing tables before and after applying a correction curve.
Figure 13:
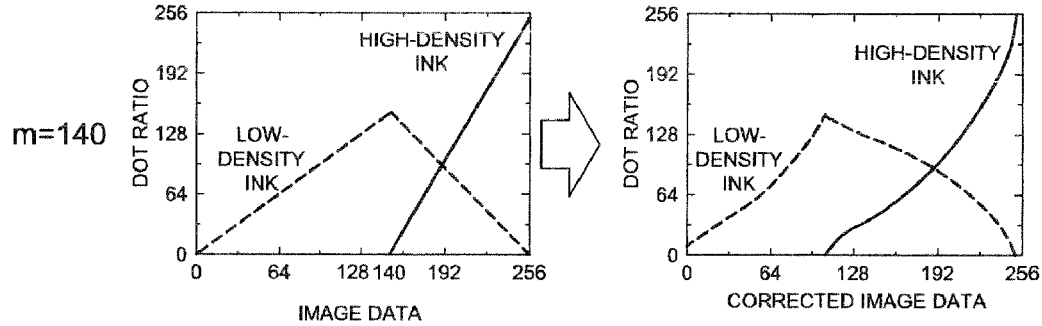
Figure 13:
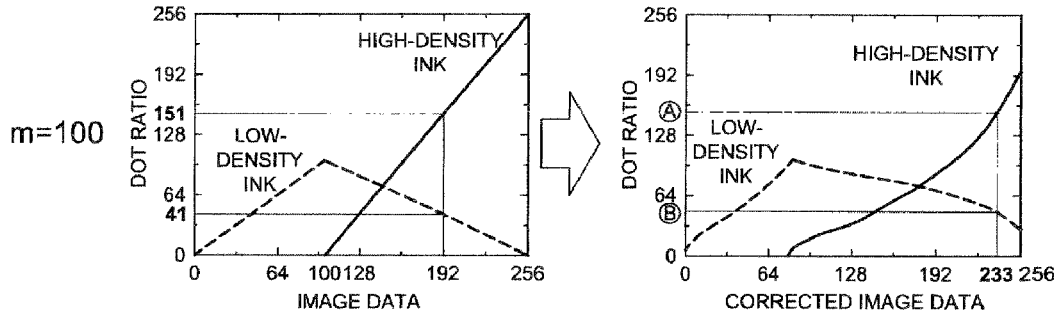

Next, the gradation correction curves abovementioned is applied to the variable density decomposing tables. Referring to graphs shown in FIGS. 13(*a*) through 13(*c*), this processing will be detailed in the following. FIG. 13(*a*), FIG. 13(*b*) and FIG. 13(*c*) indicate the variable density decomposing tables in respect to image data at "m=128", "m=140" and "m=100", and the other variable density decomposing tables in respect to corrected image data at "m=128", "m=140" and "m=100", respectively. The corrected image data are converted from the image data by employing the gradation correction LUT corresponding to value "m" concerned. Concretely speaking, the variable density decomposing tables shown in FIGS. 13(*a*) through 13(*c*) are created through the processes described as follows. In the graph after the correction, shown in FIG. 13(*c*), in order to acquire a correction value "A" of the high-density Ink and a correction value "B" of the low-density ink when the value of the corrected image data is equal to 233, at first, by using the curve at "m=100" shown in FIG. 12, the corrected image data is converted to the image data. As found from the chart shown in FIG. 12, the value of the image data corresponding to 233 of the corrected image data is equal to 192. Successively, the values of the high-density ink and the low-density ink, corresponding to 192 of the image data are read from the variable density decomposing table before correction shown in FIG. 13(*c*) As a result, the correction values of the high-density ink and the low-density ink are found as 151 and 41, respectively, from the graph before correction shown in FIG. 13(*c*). In the above calculation, the figure under the decimal point is cut off. The values, found according to the abovementioned process, corresponds to the corrected image data value=233, namely, resulting in correction value "A"=151 and correction value "B"=41. Since this correction curve is utilized for linearizing the brightness change versus the gradation change, by using the variable density decomposing table after correction, it becomes possible to represent the same brightness in the variable density decomposing for every value "m" as far as the value of the corrected image data is the same. In other words, the abovementioned fact means that, by processing the corrected image data converted from the inputted image data, its brightness can be maintained even if the value "m" is freely changed. In the present embodiment, the variable density decomposing tables of the high-density dots and the low-density dots for the corrected image data in respect to values "m" from "m=0" to "m=150" are retained on the arrangement memory, and stored into the correspondence relationship retaining section 120.

The following processing is implemented in the practical image forming operation. Initially, when the values of the image data and the nozzle position "x" are inputted, the controlling section 101 selects a value "m" corresponding to the nozzle position "x" from the mixture ratio profile stored in the mixture ratio determining section 170. Successively, the controlling section 101 acquires the corresponding correction value to be shared by the high-density ink and the low-density ink by using the value "m" and the inputted image data found from the variable density decomposing table of the high-density dots and the low-density dots versus corrected image data, stored in the correspondence relationship retaining section 120 (Step S311 shown in FIG. 3). Then, the first halftone processing section 102*a* and the second halftone processing section 102*a* conduct controlling operations to binarize the corrected multi-value image data to quasi-gradation image data by employing the dithering method, so as to implement the image forming operation based on the processed image data (Step S312 shown in FIG. 3).

Although, in the abovementioned embodiment of the present invention, the variable density decomposing table to which the gradation correction curve is applied is stored in the correspondence relationship retaining section, the scope of the present invention is not limited to the above. It is also applicable that the variable density decomposing table in respect to the image data is stored in the correspondence relationship retaining section, and the gradation correction table of the value "m" corresponding to the acquired dot ratio between the high-density dots and the low-density dots is applied. Either the timing immediately before entering into the halftone processing section or the other timing when arranging the dithering threshold levels in the halftone processing section can be considered as the timing for applying the gradation correction table concerned. Any one of the abovementioned cases is equivalent to the processing to be conducted in the present embodiment.

As the result of the abovementioned processing, it becomes possible to attain such an effect that the defect is hardly recognized since the mixture ratio of the ink to be emitted from the defect nozzle decreases at adjacent nozzles located in the vicinity of the defect nozzle concerned. Further, since the control processing is applied to the nozzles residing in the peripheral area of the defect nozzle, instead of the position of the defect nozzle itself, it also becomes possible to attain such another effect that the countermeasures for eliminating the defect can be implemented with such an accuracy or resolution that is lower than the nozzle arrangement resolution. Still further, due to the abovementioned effects, it becomes possible not only to employ a low cost detector, but also to make the processing faster than ever.

In this connection, in the abovementioned case, by detecting presence or absence of ink emitting capability for every nozzle to detect the position of the defect nozzle, it becomes possible to accurately specify the position of the defect nozzle, resulting in an improvement of the accuracy of the countermeasures for eliminating the defect.

Further, by detecting the position of the defect nozzle from the measuring result of the density distribution of the printed image in a longitudinal direction of the nozzle arrangement, it becomes possible to accurately detect the position of the defect nozzle, resulting in an improvement of the accuracy of the countermeasures for eliminating the defect.

Still further, by dividing the nozzles of the head into plural areas, the number of which is smaller than the total number of nozzles, to conduct the detecting operation with resolution being coarser than the nozzle arrangement resolution, it becomes possible to effectively conduct the detecting operation, which is suitable for decreasing the mixture ratio of the ink to be emitted from the defect nozzle at adjacent nozzles located in the vicinity of the defect nozzle concerned, without conducting any waste processing. Accordingly, it also becomes possible to attain a high-speed processing capability.

Still further, by changing the mixture ratio continuously or stepwise in the area, which is located adjacent to the other area including the defect position and includes no defect, it becomes possible to suppress the occurrence of the tone discontinuity, so as to form such an image in which the defect-elimination countermeasure applied area is naturally connected to the other area.

Still further, by acquiring two dimensional image densities in both the nozzle arrangement direction and the direction orthogonal to the nozzle arrangement direction, it becomes possible to measure the granularity of the image. Accordingly, by correcting the result of the processing for eliminating the defect in view of the granularity, it becomes possible to form a high-quality image being higher than ever.

Still further, by finding a number of defect recording elements included in each of the areas abovementioned so as to determine the mixture ratio corresponding to the Found number of the defect recording elements, it becomes possible to appropriately conduct the processing for eliminating the defects.

In this connection, in the aforementioned embodiment, by setting the density, to be represented by using only the lowest-density recording material among the recording materials belonging to the same color category but being different in density, at the maximum density, it becomes possible to freely set the mixture ratio of the recording materials concerned. Accordingly, it becomes possible not only to avoid such a case that the correcting operation becomes incapable, but also to conduct an appropriate processing.

Still further, according to the present embodiment aforementioned, since the ink is employed as the recording material, while the nozzle is employed as the recording element, it becomes possible for the ink-jet printer to apply an appropriate processing to the specific nozzle suffered by an ink clogging failure, so as to form an image in which no white line is generated.

Yet further, as a modified application other than the present embodiment described in the foregoing, by employing a thermal transfer material as the recording material, while employing a thermal transfer recording element as the recording element, it becomes possible for an electro-photographic printer or a thermal transfer printer to apply an appropriate processing to the specific recording element having a kind of defect, so as to form an image in which no white line is generated.

According to the present invention, the following effects can be attained.

(1) When forming an image in such a manner that plural kinds of recording materials, belonging to a same color category but being different in density, are adhered onto a recording medium by a plurality of recording elements, respectively, so as to form dots representing the image to be printed on the recording medium, since employed is such an image forming method that includes the steps of: detecting a defect position at which no recording material is outputted from a specific one of the plurality of recording elements; specifying the specific one of the plurality of recording elements, which resides at the defect position detected in the detecting step, as a defect recording element, and a kind of recording material to be outputted by the defect recording element; determining a mixture ratio of the plural kinds of recording materials, belonging to the same color category but being different in density, corresponding to image data representing the image to be printed, so as to make the mixture ratio of a specific recording material to be outputted by plural recording elements residing in a peripheral area of the defect position and including the defect recording element specified in the specifying step, decrease to a value lower than a normal mixture ratio, while using the normal mixture ratio for other recording elements residing in other areas; retaining a correspondence relationship between a gradation correction characteristic corresponding to the mixture ratio and the mixture ratio concerned; and conducting controlling operations, so as to implement an image forming operation by referring to the correspondence relationship and by using the gradation correction characteristic corresponding to the mixture ratio determined in the determining step, it becomes possible to attain such an effect that the defect is hardly recognized since the mixture ratio of the ink, to be emitted from the defect recording element, decreases at adjacent recording elements located in the vicinity of the defect recording element concerned. Further, since the control processing is applied to the recording elements residing in the peripheral area of the defect recording element, instead of the position of the defect recording element itself, it also becomes possible to attain such another effect that the countermeasures for eliminating the defect can be implemented with such an accuracy or resolution that is lower than the recording element arrangement resolution. Still further, due to the abovementioned effects, it becomes possible to make the processing faster than ever.

(2) Since the defect position is detected by determining whether or not the recording material is outputted for every set of plural recording elements in the detecting step of item 1, and the detection and control processing are applied to a plurality of recording elements included in the peripheral area of the defect recording element, instead of the position of the defect recording element itself, it becomes possible to attain such effect that the countermeasures (detection and control) for eliminating the defect can be implemented with such an accuracy or resolution that is lower than the recording element arrangement resolution. Accordingly, due to the abovementioned effect, it becomes possible to make the processing faster than ever.

(3) Since the detect position is detected from a result of measuring a density distribution of an image printed in a longitudinal direction of an arrangement of the plurality of recording elements in the detecting step of item 1, it becomes possible to attain such effect that the countermeasures (detection and control) for eliminating the defect can be implemented with such an accuracy or resolution that is lower than the recording element arrangement resolution. Accordingly, due to the abovementioned effect, it becomes possible to make the processing faster than ever.

(4) Since a detecting operation is conducted with resolution being coarser than an arrangement resolution of the plurality of recording elements, by dividing the plurality of recording elements into plural areas, a number of which is smaller than a total number of the plurality of recording elements in the detecting step of item 1 or 3, it becomes possible to effectively conduct the detecting operation, which is suitable for decreasing the mixture ratio of the ink to be emitted from the defect recording element at adjacent recording elements located in the vicinity of the defect recording element concerned, without conducting any waste processing. Accordingly, it also becomes possible to attain a high-speed processing capability.

(5) Since the mixture ratio is changed continuously or stepwise in an area, which is located adjacent to another area including the defect position and includes no defect, it becomes possible to suppress the occurrence of the tone discontinuity, so as to form such an image in which the defect-elimination countermeasure applied area is naturally connected to the other area.

(6) By acquiring two dimensional image densities in both an element arrangement direction of the plurality of recording elements and a direction orthogonal to the element arrangement direction. It becomes possible to measure the granularity of the image. Accordingly, by correcting the result of the processing for eliminating the defect in view of the granularity, it becomes possible to form a high-quality image being higher than ever.

(7) By calculating a number of defect recording elements included in each of the plural areas so as to determine the mixture ratio corresponding to the number of defect recording elements, it becomes possible to appropriately conduct the processing for eliminating the defects.

(8) Since a gradation correction curve is established, so as to set a density, which can be represented by using only a lowest-density recording material among recording materials belonging to a same color category but being different in density, at a maximum density, it becomes possible to freely set the mixture ratio of the recording materials concerned Accordingly, it becomes possible not only to avoid such a case that the correcting operation becomes incapable, but also to conduct an appropriate processing.

(9) Since the recording material is an inks, and the recording element is a nozzle that emits the ink, it becomes possible for the ink-jet printer to apply an appropriate processing to the specific nozzle suffered by an ink clogging failure, so as to form an image in which no white line is generated.

While the preferred embodiments of the present invention have been described using specific term, such description is for illustrative purpose only, and it is to be understood that changes and variations may be made without departing from the spirit and scope of the appended claims.

What is claimed is:

1. An image forming method for forming an image in such a manner that plural kinds of recording materials, which belong to a same color category and which are different in density, are adhered to a recording medium by a plurality of recording elements, respectively, so as to form dots representing the image to be printed on the recording medium, the image forming method comprising:

detecting a defect position at which no recording material is outputted from one of the plurality of recording elements;

identifying said one of the plurality of recording elements, which is at the detected defect position as a defect recording element, and identifying a kind of the recording material that cannot be outputted by the defect recording element as a defect recording material;

determining mixture ratios of the plural kinds of recording materials belonging to the same color category and different in density for every position of the plurality of recording elements, in such a manner that a mixture ratio at each position of recording elements which are in an area that includes the defect position and a peripheral area of the defect position, is lower than a mixture ratio of the plural kinds of recording materials at each position of other recording elements which are capable of outputting the defect recording material and are in an area other than said area that includes the defect position and the peripheral area of the defect position;

converting image data of the image to be printed to dot ratios, which respectively correspond to the plural kinds of recording materials, based on the determined mixture ratios; and executing controlling operations, so as to implement an image forming operation by employing the dot ratios.

2. The image forming method of claim 1, further comprising:

retaining the mixture ratios and respective corresponding gradation correction characteristics, and correlating said mixture ratios and said corresponding respective gradation correction characteristics;

wherein the controlling operations are executed by referring to a correspondence relationship between the mixture ratios and the respective corresponding gradation correction characteristics, and by using the respective corresponding gradation correction characteristics.

3. The image forming method of claim 1, wherein the defect position is detected by determining whether or not the recording material is outputted for every set of plural recording elements.

4. The image forming method of claim 1, wherein the defect position is detected from a result of measuring a density distribution of an image printed in a longitudinal direction of an arrangement of the plurality of recording elements.

5. The image forming method of claim 1, wherein, in detecting the defect position, a detecting operation is performed under a condition such that a detecting resolution is coarser than an arrangement resolution of the plurality of recording elements.

6. The image forming method of claim 4, wherein, in determining the mixture ratios, the mixture ratio is changed continuously or stepwise over an area from the defect position to other positions in the peripheral area of the defect position at which recording elements have no defect.

7. The image forming method of claim 4, further comprising:

acquiring two dimensional image densities in both an element arrangement direction of the plurality of recording elements and a direction orthogonal to the element arrangement direction;

wherein the mixture ratios are determined in accordance with the two dimensional image densities.

8. The image forming method of claim 5, wherein the plurality of recording elements are divided into plural areas, a number of the areas being smaller than a total number of the plurality of recording elements;

wherein the method further comprises calculating a number of defect recording elements included in each of the plural areas; and wherein the mixture ratios are determined in accordance with the number of defect recording elements included in each of the plural areas.

9. The image forming method of claim 1, wherein a gradation correction curve is established, so as to set a density, which can be represented by using only a lowest-density recording material among the plural kinds of recording materials belonging to the same color category and different in density, as a maximum density.

10. The image forming method of claim 1, wherein the recording material is an ink, and the recording element is a nozzle that emits the ink.

11. An image forming apparatus for forming an image in such a manner that plural kinds of recording materials, which belong to a same color category and which are different in density, are adhered to a recording medium by a plurality of recording elements, respectively, so as to form dots representing the image to be printed on the recording medium, the image forming apparatus comprising:

a defect position detecting section to detect a defect position at which no recording material is outputted from one of the plurality of recording elements;

a defect position identifying section to identify said one of the plurality of recording elements, which is at the defect position detected by the defect position detecting section, as a defect recording element, and to identify a kind of the recording material that cannot be outputted by the defect recording element as a defect recording material;

a mixture ratio determining section to determine mixture ratios of the plural kinds of recording materials belonging to the same color category and different in density for every position of the plurality of recording elements, in such a manner that a mixture ratio at each position of recording elements which are in an area that includes the defect position and a peripheral area of the defect position, is lower than a mixture ratio of the plural kinds of recording materials at each position of other recording elements which are capable of outputting the defect recording material and are in an area other than the area that includes the defect position and the peripheral area of the defect position;

an image data converting section to convert image data of the image to be printed to dot ratios, which respectively correspond to the plural kinds of recording materials, based on the mixture ratios determined by the mixture ratio determining section; and a controlling section to execute controlling operations, so as to implement an image forming operation by employing the dot ratios.

12. The image forming apparatus of claim 11, further comprising:

a retaining section to retain the mixture ratios and respective corresponding gradation correction characteristics, and correlating said mixture ratios and said corresponding respective gradation correction characteristics;

wherein the controlling section executes the controlling operations by referring to a correspondence relationship between the mixture ratios and the respective corresponding gradation correction characteristics, and by using the respective corresponding gradation correction characteristics.

13. The image forming apparatus of claim 11, wherein the defect position detecting section detects the defect position by determining whether or not the recording material is outputted for every set of plural recording elements.

14. The image forming apparatus of claim 11, wherein the defect position detecting section detects the defect position from a result of measuring a density distribution of an image printed in a longitudinal direction of an arrangement of the plurality of recording elements.

15. The image forming apparatus of claim 11, wherein the defect position detecting section performs a detecting operation under a condition such that a detecting resolution is coarser than an arrangement resolution of the plurality of recording elements.

16. The image forming apparatus of claim 14, wherein the mixture ratio determining section changes the mixture ratio continuously or stepwise over an area from the defect position to other positions in the peripheral area of the defect position at which recording elements have no defect.

17. The image forming apparatus of claim 14, further comprising:

an image density acquiring section to acquire two dimensional image densities in both an element arrangement direction of the plurality of recording elements and a direction orthogonal to the element arrangement direction;

wherein the mixture ratios are determined in accordance with the two dimensional image densities.

18. The image forming apparatus of claim 15, wherein the plurality of recording elements are divided into plural areas, a number of the areas being smaller than a total number of the plurality of recording elements;

wherein the apparatus further comprises a defect number calculating section to calculate a number of defect recording elements included in each of the plural areas; and wherein the mixture ratios are determined in accordance with the number of defect recording elements included in each of the plural areas calculated by the defect number calculating section.

19. The image forming apparatus of claim 11, wherein a gradation correction curve is established, so as to set a density, which can be represented by using only a lowest-density recording material among the plural kinds of recording materials belonging to the same color category and different in density, as a maximum density.

20. The image forming apparatus of claim 11, wherein the recording material is an ink, and the recording element is a nozzle that emits the ink.

* * * * *